US009540839B1

(12) United States Patent
Gross

(10) Patent No.: US 9,540,839 B1
(45) Date of Patent: Jan. 10, 2017

(54) ADJUSTABLE UNIVERSAL POST CAP

(71) Applicant: William Powers Gross, Jacksonville, IL (US)

(72) Inventor: William Powers Gross, Jacksonville, IL (US)

(73) Assignee: William Powers Gross, Jacksonville, IL (US)

( * ) Notice: Subject to any disclaimer, the term of this patent is extended or adjusted under 35 U.S.C. 154(b) by 0 days.

(21) Appl. No.: 14/845,769

(22) Filed: Sep. 4, 2015

(51) Int. Cl.
*E04H 12/04* (2006.01)
*E04H 17/20* (2006.01)
*E04H 17/00* (2006.01)

(52) U.S. Cl.
CPC ..... *E04H 12/04* (2013.01); *E04H 17/20* (2013.01); *E04H 2017/006* (2013.01)

(58) Field of Classification Search
None
See application file for complete search history.

(56) References Cited

U.S. PATENT DOCUMENTS 1,409,155 A * 3/1922 Covan ..... E04H 17/20 52/297
1,707,397 A 4/1929 Hurst
1,996,400 A 4/1935 Bowen
2,695,554 A * 11/1954 Jenson ..... E04D 13/1471 454/35
2,710,996 A * 6/1955 Pittman ..... E04H 12/04 52/301
3,173,662 A * 3/1965 Millerbernd ..... E04H 17/10 256/52
3,289,374 A * 12/1966 Metz ..... E04G 23/0203 52/514
3,352,581 A 11/1967 Robbins et al.
3,377,808 A * 4/1968 Dougherty ..... E02D 13/10 405/250
4,039,166 A * 8/1977 Elgin ..... E04H 17/20 256/65.07
4,161,090 A * 7/1979 Watts, Jr. ..... E04H 12/04 264/46.6
4,324,388 A * 4/1982 Klaser ..... E04H 17/1413 256/13.1
4,602,765 A * 7/1986 Loper ..... E04H 17/1413 256/19
4,623,756 A * 11/1986 Wilson, Jr. ..... H01B 17/145 174/158 F
5,419,536 A 5/1995 Bender
5,421,556 A * 6/1995 Dodge ..... E04H 17/20 256/1
5,778,611 A * 7/1998 Michel ..... E04D 13/14 285/331
5,853,167 A * 12/1998 West ..... E04H 17/20 256/19
6,006,479 A 12/1999 Fayle
6,138,422 A 10/2000 Wall et al.
(Continued)

OTHER PUBLICATIONS

Photograph of Fence Post Cover taken prior to the filing date of the present application (prior to Sep. 4, 2015). Accepted As Prior Art.

*Primary Examiner* — Rodney Mintz
(74) *Attorney, Agent, or Firm* — Cook Alex Ltd.

(57) ABSTRACT

An adjustable pole cap that includes a peripheral rim that defines an adjustable opening that may be adjusted to receive different sized pole tops, and blanks for forming such caps.

12 Claims, 2 Drawing Sheets

(56) References Cited

U.S. PATENT DOCUMENTS

| | | | | |
|---|---|---|---|---|
| D458,390 | S | 6/2002 | Ohanesian | |
| 6,691,473 | B1 * | 2/2004 | Mayle | E04D 13/1407 285/42 |
| 6,698,725 | B1 * | 3/2004 | Berry | E04H 17/066 256/11 |
| 6,954,947 | B1 * | 10/2005 | Williams, Jr. | E04F 17/026 4/218 |
| D582,573 | S | 12/2008 | Fears | |
| 8,844,907 | B1 | 9/2014 | Davis et al. | |
| 2002/0125468 | A1 * | 9/2002 | Fischer | E04H 17/20 256/19 |
| 2003/0066992 | A1 * | 4/2003 | Burkart | E04H 17/20 256/1 |
| 2003/0106273 | A1 * | 6/2003 | Neylon | E04H 17/20 52/244 |
| 2003/0160222 | A1 * | 8/2003 | Steffes | E04H 17/1443 256/1 |
| 2003/0182876 | A1 * | 10/2003 | Landers | A01M 29/06 52/101 |
| 2004/0240943 | A1 * | 12/2004 | Brensinger | E02D 5/60 405/211 |
| 2005/0210786 | A1 * | 9/2005 | Hales | E04H 17/20 52/301 |
| 2005/0269390 | A1 * | 12/2005 | Martin | B65D 81/3869 229/403 |
| 2006/0033091 | A1 * | 2/2006 | Fattori | B29C 65/08 256/19 |
| 2006/0202186 | A1 * | 9/2006 | Rowley | E04H 17/1417 256/67 |
| 2007/0180784 | A1 | 8/2007 | Smith | |

* cited by examiner

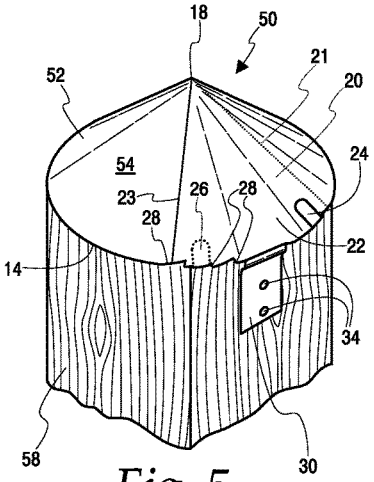
Fig. 5
Fig. 6
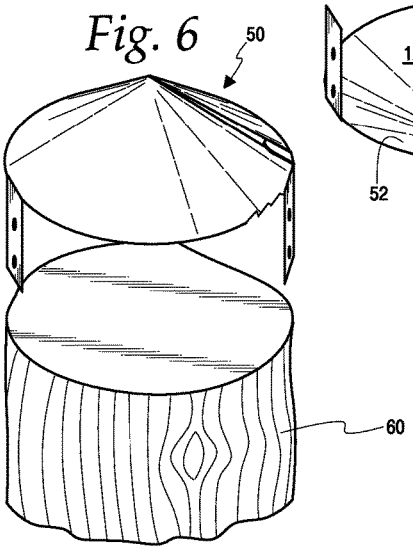
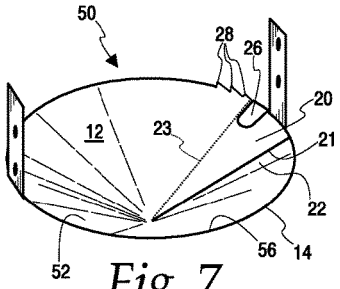
Fig. 7

ADJUSTABLE UNIVERSAL POST CAP

TECHNICAL FIELD

The present disclosure generally relates to pole caps, and more particularly to protective pole/post caps that are adjustable in size so as to fit poles of different sizes and/or shapes.

BACKGROUND

Wood poles/post are used in several different applications including, but not limited to, supporting fencing, boat docks and utility lines. In many instances, the poles are made from lumber that has been cut or otherwise shaped for the particular application and then driven or otherwise anchored into the ground. In other instances, the poles may be made from tree stumps or trunks of dead trees. In such instances, the dead branches are trimmed from the stumps/trunks and the stumps/trunks of the dead trees are cut to a desired height. For example, in several rural and agricultural regions Osage Orange or other types of trees are used as a natural form of fencing. It is common for dead Osage Orange trees to be trimmed down to the stump/trunk and the trimmed stumps/trunks to be uses as a fence post.

One issue that is common to all wooden poles/posts, whether formed from lumber or a dead tree stump/trunk, is deterioration of the top of the wooden pole due to exposure to the elements. Wood poles are susceptible to degradation due to exposure to ultraviolet sunlight and water. UV sunlight degrades the wood at the top end of the pole, causing the wood at the top to become weaker. Water softens and seeps into exposed wood at the end of the pole. As deterioration begins to occur on the top of the pole, depressions or indentations form in which water can pool. The pooling of water on the top of the pole increases or speeds up the rate of deterioration. In certain climates, the water absorbed by the wood may go through freeze and thaw cycles that expand and contact the wood fibers. Such decay oftentimes leads to split and/or weakened poles.

Caps sometimes have been used to cover the ends of poles. Such caps are typically designed to fit poles of a particular size and shape. That is, oftentimes the caps are provided in pre-set sizes. Because the size and shapes of poles formed from trimmed stumps/trunks vary from pole to pole, such pre-set caps may not fit on such poles and caps of different shapes and sizes would be required to cover a set of such poles. In other instances, cast off material such as license plates, scrap metal and old boots have also been used to fabricate crude covers/caps that do not always provide sufficient protection to the top of the pole.

Therefore, there is a need for pole caps that can fit a variety of different size pole tops and in particular a need for pole caps in agricultural applications where post are oftentimes made from irregularly sized and shaped posts.

SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect of the present disclosure, a size adjustable pole cap for mounting onto a top end of a pole wherein the pole cap includes a body having a wall. The wall includes a bottom peripheral rim that defines a size adjustable opening which is adjustable to receive different sized pole ends. The wall also has first and second portions which are configured to overlap and move relative to one another to adjust the size of the opening.

In another aspect, a size adjustable pole cap for mounting onto a top end of a pole wherein the pole cap includes a hollow, generally conical body having a wall that includes a bottom peripheral rim defining a size adjustable opening that is adjustable to receive different sized pole ends. The wall also includes a slit between a first portion and a second portion, wherein the first and second portions are configured to overlap and move relative to one another so as to adjust the size of the opening.

In yet another aspect, a blank for forming a generally conical, size adjustable pole cap wherein the blank includes a generally circular, flat sheet of material that has a center and an outer peripheral edge. The sheet includes a slit extending from the outer peripheral edge toward the center wherein the slit separates a first portion and a second portion of the sheet. The first and second portions of the sheet being movable relative to one another into an overlapped configuration when the sheet is bent to form a generally conical shape. The blank also includes one or more attachment members for attaching the pole cap to a pole wherein the one or more attachment members extend from the outer peripheral edge.

BRIEF DESCRIPTION OF DRAWINGS

FIG. 5 is perspective view of a pole cap in accordance with the present disclosure shown on top of a pole having a square cross-sectional shape;

FIG. 6 is perspective view of a pole cap in accordance with the present disclosure shown being placed on top of an irregularly shaped pole formed from a tree trunk; and FIG. 7 is a bottom perspective view of the pole cap of FIG. 5.

DETAILED DESCRIPTION

The embodiments disclosed herein are for the purpose of providing a description of the present subject matter, and it is understood that the subject matter may be embodied in various other forms and combinations not shown in detail. Therefore, specific embodiments and features disclosed herein are not to be interpreted as limiting the subject matter as defined in the accompanying claims. As used herein the terms "pole," "post" and "pole/posts" are used interchangeably.

The present disclosure discloses adjustable protective pole/post caps that may be placed over and attached to the top end of a pole to protect the end of the pole from the elements, e.g., sunlight, water, etc. The present disclosure also relates to blanks for forming such adjustable pole/post caps. The pole caps are adjustable in size so that a single cap is able to fit over a range of pole sizes, i.e., poles of varying cross-sectional sizes. The caps are also universal so as to be capable of fitting over poles having a variety of regular and irregular cross-sectional shapes. The adjustable pole caps disclosed herein may be particularly useful in protecting the end of fence posts made from dead tree stumps/trunks wherein each pole along the fence may have a different size and shape. In such application, the cap can be adjusted during installation to fit the particular size and shape of a given pole. The pole caps are also useful in other applications as well, such as protecting the tops of poles made from lumber that has cut to a uniform size and shape or mechanically machined natural tree posts such as pine/creosote treated posts, which are known to have a greater susceptibility to deterioration and rot.

FIGS. 1-4 illustrate different embodiments of pole cap blanks that are bent or deformed to form adjustable pole caps, such as those shown in FIGS. 5-7. In the illustrated embodiments, the blanks are generally flat, generally circular shaped sheets which are bent or otherwise deformed by the user to form the adjustable, generally conically shaped pole caps shown in FIGS. 5-7. In other embodiments, the blanks may have a generally flat, generally polygonal shape, such a rectangle, that may be bent to form a polyhedral shaped cap, such as a generally pyramid shaped cap. One advantage, among others, provided by such blanks and adjustable pole caps formed therefrom is that the generally flat configuration of the blanks allows for easy and efficient storage and transport of the blanks before being bent to form the adjustable cap.

The features associated with each of the respective pole cap blanks shown in FIGS. 1-4 and the formed pole caps shown in FIGS. 5-7 are shown for exemplary purposes and such features may be employed or combined with any of the other features shown on other blanks/pole caps.

Figure 1:
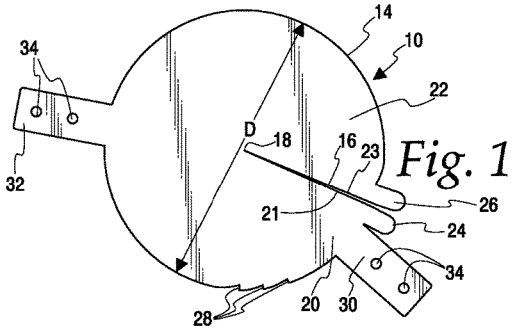
FIG. 1 is a top view of one embodiment of a pole cap blank that may be formed into an adjustable pole cap in accordance with the present disclosure.

Referring to FIGS. 1 and 5, these figures show one embodiment of a blank 10 (FIG. 1) and the associated pole cap 50 (FIG. 5) formed therefrom in accordance with the present disclosure. Where applicable, corresponding parts of the blank 10 and pole cap 50 have been identified with the same reference numbers.

Turning to FIG. 1, the blank 10 includes a generally flat sheet 12 of flexible material. The sheet 12 has a generally circular shape, which may be any suitable circular shape, such as a right circular shape, oval shape or elliptical shape. In an alternative embodiment, the sheet 12 may also have a generally polygonal shape, such as a rectangle. The material from which the sheet 12 is made may be a metal (e.g., aluminum or copper), a polymeric material, any other suitable bendable or deformable, non-corrosive material or any combination of these materials. Sheet 12 may be stamped out or cut (snipped or laser cut) from a larger sheet of material. When made of a polymeric material, in addition to stamping or cutting, the sheet also may be formed by molding, such as injection molding.

The sheet 12 includes an outer peripheral edge 14 that extends generally around the periphery of the sheet 12. A slit 16 extends radially inwardly from the outer peripheral edge 14 toward the center 18 of the sheet 12. In the illustrated embodiment, the slit 16 extends from the outer peripheral edge 14 all the way to the center 18 of sheet 12. On one side of the slit 16 is a first portion 20 of the sheet 12 and on the other side of the slit 16 is a second portion 22 of the sheet 12. The first portion 20 has an edge 21 and the second portion 22 has an edge 23 wherein the slit 16 is defined between edges 21 and 23. As discussed in more detail below, when the blank 10 is bent or deformed to form the body 52 of the pole cap 50 (FIG. 5), first and second portions 20 and 22 of sheet 12 move relative to and passed one another into an overlapped configuration. In other words, one of the first or second portions 20 and 22 moves under the other portion so that the portions overlap.

Optionally, sheet 12 may also include one or more tabs 24, 26 that are associated with the first and/or second portions 20 and 22 of sheet 12. In the illustrated embodiment, a first tab 24 is associated with the first portion 20 and a second tab 26 is associated with the second portion 22. When forming the blank 10 into the pole cap 50, the user may grasp first and second tabs 24 and 26 and move one over the other and then passed each other to move the first and second portions 20 and 22 of the sheet 12 relative to one another. Optionally, the tabs 24 and 26 may also function as retaining elements that retain the first and second portions 20 and 22 in a fix relation relative to one another, thereby retaining the sheet 12 in the form of the cap 50. As shown in FIG. 5, the tab 24 associated with portion 20 (shown in phantom) may be bent over the outer peripheral edge 14 and extend over portion 22. Likewise, tab 26 (shown in phantom) associated with portion 22 may be bent over the peripheral edge 14 and extend over portion 20 to retain the portions 20 and 22 in fixed relation. Optionally, the outer peripheral edge 14 may include one or more catches, such as one or more notches 28, that the bent tab 26 engages to assist in holding the tab 26 in place. In the illustrated embodiment, the outer peripheral edge 14 includes three notches 28 that tab 26 may engage. Each of the notches 28 corresponds to a different size to which the cap may be adjusted.

Turning back to FIG. 1, the blank 10 also includes one or more attachment members, such as attachment projections or arms 30 and 32, extending radially outwardly from the outer peripheral edge 14 of sheet 12. In the illustrated embodiment, the projections 30 and 32 include holes 34 therethrough for receiving fasteners, such as nails or screws, to attach the cap 50 (FIG. 5) to the post 58. In the illustrated embodiment, each of the projections 30, 32 includes two radially spaced apart holes 34. In other embodiments, there may only be one hole 34 or no holes. When no holes are present, a fastener may be driven through the projection(s) 30, 32 to attach the cap 50 to the pole. In the illustrated embodiment, the attachment projections 30, 32 are offset on the blank 10. This is so that the projections 30, 32 become generally opposed in the cap 50 thus formed from blank 10. In other embodiments, the attachment projection 30, 32 may be generally opposed in the blank. In still other embodiments, the blank 10/cap 50 may include more than two attachment projections which may be uniformly or non-uniformly spaced-apart. For example, for larger pole caps that are designed to cover poles of larger diameters, the blank 10/cap 50 may have four or six attachment members.

Prior to or during installation of the cap 50 (FIG. 5), the installer grasps taps 24 and 26 of blank 10 and moves them relative to each other so as to move portions 20 and 22 of sheet 12 passed each other into an overlapped configuration. Referring to FIGS. 5 and 7, when this takes place, the blank 10 forms into cap 50 having a hollow, generally conical body 52 wherein the sheet 12 of the blank 10 becomes a wall 54 of the body 52, the center of the sheet 12 of blank 10 becomes the apex 18 of the generally conical body 52, and the outer peripheral edge of the sheet 12 of blank 10 becomes the bottom peripheral rim 14 of the wall 54.

Referring to FIG. 7, the bottom peripheral rim 14 defines an adjustable opening 56 wherein the size of opening 56 may be adjusted to receive different sized pole tops. The size of opening 56 may be adjust by moving overlapped portions 20 and 22 of wall 54 relative to one another. For example, moving portions 20 and 22 so as to increase the amount of overlap will result in reducing the size of opening 56. Conversely, moving portions 20 and 22 so as to decrease the amount of overlap will result in increasing the size of the opening.

Referring to FIGS. 5 and 7, once the installer has selected the desired size for the cap 50, the installer folds tabs 24 and 26 over the bottom peripheral rim 14 to retain the portions 20 and 22 in a fixed position. The tabs may engage notches 28, if present. In the illustrated embodiment, portion 20 (shown in phantom in FIG. 5) of wall 54 is under portion 22 and tab 24 is bent over rim 14 and extends over the outer surface of the wall 54. Conversely, tab 26 (shown in phantom in FIG. 5) is bent over rim 14, engages notch 28, and extends over the inner surface of wall 54.

The cap 50 is placed over the top of the pole 58 and the attachment members, projections 30, 32, are bent relative to the rim 14 so as to contact the pole 58. Fasteners may then be placed through the holes 34 and driven into the pole 58 to attached cap 50 to the pole. In FIG. 5, the illustrated pole 58 is made from lumber that has been cut to have a square cross-sectional shape. The cap 50 however, may be installed on a pole of any size or shape. For example, referring to FIG. 6, the cap 50 is shown being installed on the top of an irregularly sized and shaped tree stump/trunk that has been formed into a pole 60, such as an Osage Orange tree stump/trunk which is commonly used as a fence post. Once installed, the cap 50 protects the top of the pole 58/60 from water and sun light.

Figure 3:
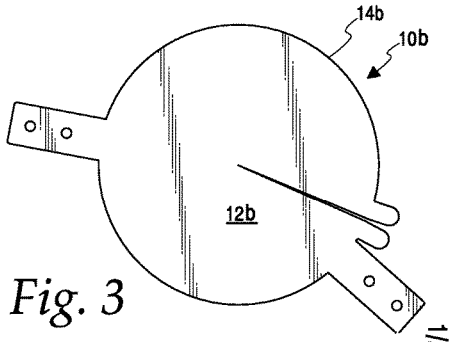
FIG. 3 is a top view of another embodiment of a pole cap blank that may be formed into an adjustable pole cap in accordance with present disclosure.
Figure 2:
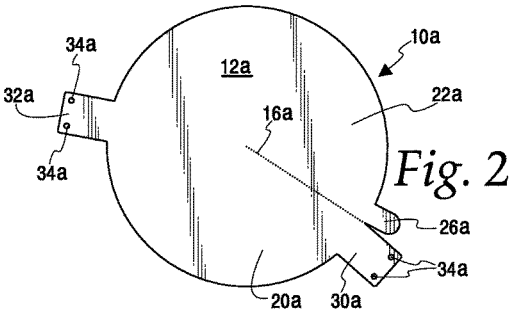
FIG. 2 is a top view of another embodiment of a pole cap blank that may be formed into an adjustable pole cap in accordance with present disclosure.
Figure 4:
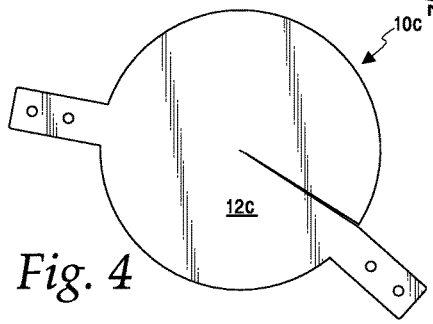
FIG. 4 is a top view of another embodiment of a pole cap blank that may be formed into an adjustable pole cap in accordance with present disclosure.

FIGS. 2-4 illustrate different embodiments of blanks that may be used to form protective adjustable pole caps in accordance with the present disclosure. FIG. 2 illustrates a blank 10*a* which has substantially the same features as blank 10 of FIG. 1 and will form a protective pole cap having substantially the same features of cap 50 shown in FIG. 5, except that the sheet 12*a* of blank 10*a* includes a perforation 16*a* that separates portion 20*a* from portion 22*a* of sheet 12*a*. Perforation 16*a* forms a slit between the portions 20*a* and 22*a* when perforation 16*a* is torn. Additionally, the attachment members 30*a*, 32*a* are shorter and wider than attachment members 30, 32 of blank 10. Also in attached member 30*a*, 32*a*, the holes 34*a* for receiving fasteners are spaced-a-part in a side-by-side configuration instead a radially spaced-apart configuration as in blank 10. Blank 10*a* also only includes one tab 26*a* which is associated with portion 22*a* of the sheet 12*a* and does not include notches 28.

FIG. 3 shows another embodiment of a blank 10*b* which has substantially the same features as blank 10 of FIG. 1 and will form a protective pole cap having substantially the same features of cap 50 shown in FIG. 5, except that the sheet 12*b* does not include the optional catches, such as notches 28, in the peripheral rim 14*b*. FIG. 4 illustrates another embodiment of a blank 10*c* which has substantially the same features as blank 10 of FIG. 1 and will form a protective pole cap having substantially the same features of cap 50 shown in FIG. 5, except that the sheet 12*c* does not include tabs 24 and 26 nor notches 28.

While the protective caps are adjustable in size, the blanks themselves may be provided in different sized diameters wherein each different sized blanks would be particularly well suited for a select range of post sizes. For example, referring to FIG. 1, the blank may have a diameter D of about 8 inches, which would be well suited for forming a cap to cover posts having diameters between about 4.5 inches and about 6.5 inches. In another embodiment, the diameter D of the blank 10 may be about 10 inches, which would be well suited for forming a cap to cover posts having diameters between about 6.5 inches and about 9 inches. In another embodiment, the diameter D may be about 12 inches, which would be well suited for forming a cap to cover posts having diameters between about 9 inches and about 11 inches. In another embodiment, the diameter D may be about 16 inches, which would be well suited for forming a cap to cover posts having diameters between about 11 inches and about 14 inches. In a further embodiment, the diameter D may be about 20 inches, which would be well suited for forming a cap to cover posts having diameters between about 14 inches and about 18 inches.

It will be understood that the embodiments described above are illustrative of some of the applications of the principles of the present subject matter. Numerous modifications may be made by those skilled in the art without departing from the spirit and scope of the claimed subject matter, including those combinations of features that are individually disclosed or claimed herein. For these reasons, the scope hereof is not limited to the above description but is as set forth in the following claims, and it is understood that claims may be directed to the features hereof, including as combinations of features that are individually disclosed or claimed herein.

The invention claimed is:

1. A size adjustable pole cap for mounting onto a top end of a pole, said pole cap comprising:

a body having a wall including a bottom peripheral rim defining a size adjustable opening that is adjustable to receive different sized pole ends;

one or more attachment members adapted to attach the body to the pole, wherein the attachment members are attached to and project from the peripheral rim;

the wall having first and second portions which are configured to overlap and move relative to one another to adjust a size of the size adjustable opening;

one or more retaining elements to assist in retaining the first and second portions of the wall in a fixed position relative to one another;

wherein the one or more retaining elements comprise one or more bendable tabs extending from the peripheral rim of the wall at or adjacent to at least one of the first and second portions;

wherein the peripheral rim includes one or more catches for receiving the one or more bendable tabs; and wherein the catches are notches located in the peripheral rim.

2. The pole cap of claim 1 wherein the pole cap is a continuous unitary structure of one-piece construction.

3. The pole cap of claim 1 further including a slit between the first and second portions.

4. The pole cap of claim 1 wherein the body has a substantially conical shape.

5. The pole cap of claim 1 wherein the one or more attachment members comprise one or more bendable projections.

6. The pole cap of claim 5 wherein the bendable projections include holes configured to receive fasteners for fastening the body to the pole.

7. A size adjustable pole cap for mounting onto a top end of a pole, said pole cap comprising:

a hollow, substantially conical body having a wall including a bottom peripheral rim defining a size adjustable opening that is adjustable to receive different sized pole ends;

one or more attachment members adapted to attach the body to the pole, wherein the attachment members are attached to and project from the peripheral rim;

a slit in the wall between a first portion and a second portion, wherein the first and second portions are configured to overlap and move relative to one another so as to adjust a size of the size adjustable opening;

one or more retaining elements to assist in retaining the first and second portions of the wall in a fixed position relative to one another;

one or more retaining elements comprise one or more bendable tabs extending from the peripheral rim of the wall at or adjacent to at least one of the first and second portions;

wherein the peripheral rim includes one or more catches for receiving the one or more bendable tabs; and wherein the catches are notches located in the peripheral rim.

8. The pole cap of claim 7 wherein the substantially conical body has a top apex and the slit extends from the apex through the peripheral rim.

9. The pole cap of claim 7 wherein the body is comprised of one or more of metal and plastic.

10. The pole cap of claim 7 wherein the one or more attachment members comprise one or more bendable projections.

11. The pole cap of claim 10 wherein the bendable projections include holes configured to receive fasteners for fastening the body to the pole.

12. A blank for forming a substantially conical, size adjustable pole cap, comprising:

a substantially circular, flat sheet of material having a center and an outer peripheral edge;

a slit extending from the outer peripheral edge toward the center, the slit separating a first portion and a second portion of the sheet wherein the first and second portions are movable relative one another into an overlapped configuration when the sheet is bent to form a substantially conical shape;

one or more attachment members for attaching the pole cap to a pole, the one or more attachment members being attached to and extending from the outer peripheral edge;

one or more retaining tabs extending from the outer peripheral edge at or adjacent to at least one of the first and second portions;

wherein the outer peripheral edge includes one or more catches for receiving the one or more retaining tabs; and wherein the catches are notches located in the outer peripheral edge.

* * * * *